US008083864B2

(12) United States Patent
Ho

(10) Patent No.: US 8,083,864 B2
(45) Date of Patent: Dec. 27, 2011

(54) CLEANING DEVICE

(76) Inventor: Edward Ho, Warren, NJ (US)

( * ) Notice: Subject to any disclaimer, the term of this patent is extended or adjusted under 35 U.S.C. 154(b) by 849 days.

(21) Appl. No.: 12/072,021

(22) Filed: Feb. 22, 2008

(65) Prior Publication Data

US 2009/0211615 A1 Aug. 27, 2009

(51) Int. Cl.
*B08B 3/02* (2006.01)

(52) U.S. Cl. ..... 134/166 C; 134/168 C; 134/168 R; 4/255.05

(58) Field of Classification Search ..... 134/169 C, 134/166 C; 4/255.04, 255.06, 255.11, 255.12
See application file for complete search history.

(56) References Cited

U.S. PATENT DOCUMENTS

| | | | | | |
|---|---|---|---|---|---|
| 1,361,972 | A | * | 12/1920 | Drake | 4/255.02 |
| 3,480,021 | A | * | 11/1969 | Ewald, Jr. | 134/24 |
| 3,608,098 | A | * | 9/1971 | Andrisani | 4/255.04 |
| 4,183,011 | A | * | 1/1980 | Massa | 134/184 |
| 4,756,480 | A | * | 7/1988 | Fish | 4/255.06 |
| 4,768,237 | A | * | 9/1988 | Torti | 4/255.05 |
| 5,308,405 | A | | 5/1994 | McElroy | 134/24 |
| 5,384,918 | A | * | 1/1995 | Leighton et al. | 4/255.05 |
| 5,546,613 | A | * | 8/1996 | Davenport | 4/255.05 |
| 5,566,401 | A | | 10/1996 | Kishi et al. | 4/300 |
| D387,524 | S | * | 12/1997 | Allen et al. | D32/35 |
| 6,049,918 | A | * | 4/2000 | White, Sr. | 4/222 |
| 6,113,010 | A | | 9/2000 | Wu-Hsiung | 239/530 |
| 6,295,660 | B1 | | 10/2001 | Schuster | 4/353 |
| 6,321,392 | B1 | | 11/2001 | Sim | 4/225.1 |
| 6,393,625 | B1 | * | 5/2002 | Tsai | 4/255.02 |
| 6,457,186 | B1 | | 10/2002 | Stewart | 4/213 |
| 6,460,215 | B1 | | 10/2002 | Dues et al. | 15/160 |
| 6,467,101 | B1 | | 10/2002 | Artola | 4/354 |
| 6,477,720 | B2 | | 11/2002 | Tomita et al. | 4/420.4 |
| 6,507,972 | B2 | | 1/2003 | Hart | 15/210.1 |
| 6,510,561 | B1 | | 1/2003 | Hammond et al. | 4/231 |
| 6,625,821 | B2 | | 9/2003 | Lhoste | 4/231 |
| 6,713,441 | B1 | | 3/2004 | DeSenna et al. | 510/191 |
| 6,754,913 | B2 | | 6/2004 | Haberkorn | 4/420.4 |
| 6,772,450 | B1 | | 8/2004 | Saylor et al. | 4/222 |

(Continued)

FOREIGN PATENT DOCUMENTS

JP 06-093635 * 4/1994

(Continued)

*Primary Examiner* — Frankie L Stinson
(74) *Attorney, Agent, or Firm* — Frommer Lawrence & Haug LLP

(57) ABSTRACT

A cleaning device for cleaning any enclosure having at least one drainage capable of enclosing one liquid. The enclosure including but, not limited to a toilet bowl, a bidet, a bathtub, a sink, a reservoir, a tank and, a shower stall. The cleaning device comprising an elongated member having a sidewall, an outer surface, an inner surface, a first end, a second end, and a substantially hollow cavity. The first end and the second end of the elongated member can either be integral or be connected by a connecting means. The cleaning device also includes a stopper disposed on the first end and a gripping member removably attached to the second end of the elongated member. A liquid level regulator is provided on the cleaning device in order to control and regulate the amount of liquid disposed in an enclosure to be cleaned in order to maximize cleaning without causing overflowing. Cleaning is accomplished by a controlling means-controlling at least one agitating means operating at an optimal frequency. The cleaning device also has a safety circuit to ensure the cleaning device is positioned at an optimal angle with sufficient liquid present in the enclosure to be cleaned.

21 Claims, 7 Drawing Sheets

U.S. PATENT DOCUMENTS

| | | | | |
|---|---|---|---|---|
| 6,907,622 | B2 * | 6/2005 | Rasaei et al. | 4/255.06 |
| 6,944,894 | B1 | 9/2005 | Blevins | 4/662 |
| 7,051,381 | B2 | 5/2006 | Furukawa et al. | 4/246.1 |
| 7,051,382 | B2 | 5/2006 | Haberkorn | 4/420.4 |
| 7,055,183 | B2 | 6/2006 | Hoehne et al. | 4/233 |
| 7,076,812 | B2 | 7/2006 | Haberkorn | 4/420.4 |
| 7,111,330 | B1 | 9/2006 | Korf | 4/226.1 |

FOREIGN PATENT DOCUMENTS

| | | | |
|---|---|---|---|
| JP | 2007-247282 | * | 9/2007 |

* cited by examiner

CLEANING DEVICE

INCORPORATION BY REFERENCE

All documents cited or referenced herein ("herein cited documents"), and all documents cited or referenced in herein cited documents, together with any manufacturer's instructions, descriptions, product specifications, and product sheets for any products mentioned herein or in any document incorporated by reference herein, are hereby incorporated herein by reference, and may be employed in the practice of the invention.

FIELD OF THE INVENTION

The present invention directs to a cleaning device for a toilet bowl, a bidet, a sink, a bathtub, a reservoir and/or any enclosure with drainage. More particularly, the present invention teaches and claims a cleaning device and method for cleaning an enclosure having at least one drainage, for example, a toilet bowl, in which the device seals the water outlet of the bowl and agitates the trapped water to clean the interior surfaces of the toilet bowl.

BACKGROUND OF THE INVENTION

Personal hygiene has always been the primary prophylactic measure in maintaining good health. Germs are spread more quickly in our world nowadays. People travel all over and acquire bacteria and viruses and transport them to places where they did not previously exist. This is especially so in hospitals or other institutions such as rehabilitation centers, homes for the elderly, etc. where patients, healthcare professionals and visitors intermingle in an atmosphere where bacteria and viruses propagate. Oftentimes, people in hospitals and institutions contract additional infections because of the hospital or institution's inability to maintain a sterile and sanitary environment. It is getting harder and increasingly more challenging to provide a germ-free environment, especially for those who have weakened immune systems. Sanitizing frequently-used areas in hospital and institutions is in itself a dirty and time-consuming job, and even with the best cleaning staff available, if it still difficult to maintain a sterile environment. There's a long-felt need to provide a hand-free cleaning device that is economical, portable, easy-to-use, fast-acting and effective in disinfecting and minimizing the spreading and the proliferation of bacteria and viruses. By providing a hands-free, easy-to-use and efficient device, the premises would be cleaner and more sanitary, thus helping to control the proliferation of bacteria and viruses.

By way of example, a typical residential or commercial toilet maintains a water level in the toilet bowl to accept new deposits of sewage and to seal off sewer gasses from entering interior living spaces. Each waste disposal cycle removes the initial volume of water plus the added waste products and provides an amount of clean water to remove waste that may have become adhered to the sides of the toilet bowl, leaving an amount of water in the toilet bowl for the next cycle. Although each cycle rinses the sides of the toilet bowl, periodic cleaning is often necessary to maintain a clean appearance and sanitary conditions. In addition to soiling from the incomplete removal of waste, microorganisms, bacteria, mineral deposits commonly found in water, paper products, and any other unsanitary items, the presence of a default amount of water at the end of each disposal cycle can lead to deposits that are difficult to remove during a disposal cycle.

Typically, the necessary periodic cleaning requires an individual to manually scrub the interior surfaces of the toilet bowl in order to remove waste, sediment, any unsanitary items, and water borne deposits that may become adhered to the sides of the bowl over time. This usually involves close contact with the water in the toilet and vigorous scrubbing to remove the waste, stains and other deposits. Such requirements usually make the task of cleaning a toilet unappealing.

The manual scrubbing associated with typical toilet bowl cleaning methods has some degree of effectiveness, and is arguably efficient, but, by itself, scrubbing is most likely ineffective in disinfecting toilet bowl surfaces. Microorganisms present in the toilet bowl water are likely redistributed by the scrubbing process. Commonly, some amount of toilet bowl water is atomized during the scrubbing process which may spread the microorganisms to surrounding surfaces. Thus, simply scrubbing the toilet bowl may result in spreading the microorganisms to unintended surfaces.

In order to achieve an acceptable level of sanitization, potentially dangerous cleaning chemicals are typically used alone or in conjunction with the manual scrubbing step. Generally, cleaning chemicals are introduced into the toilet bowl water and applied to the inside surfaces of the bowl and allowed to sit, react and clean surfaces and the soiled areas of the bowl. The surfaces of the toilet bowl that are exposed to the chemicals are then scrubbed with the chemically-treated water and a brush or similar means adapted for this purpose. Although this may be a conventional method to clean visible stains, it is largely ineffective to sanitize. Recently, however, there has been more awareness both environmentally and physically concerning the use of harmful chemicals during the cleaning process and upon subsequent use of the toilet because these disinfecting chemicals ultimately make their way into aquifers and waterways causing harm to ecosystem, environment and all living beings.

One method developed to eliminate close contact with the sewage and/or soiled water and/or toilet water involves plugging the drain to the toilet bowl and providing additional water to raise the water level to a height greater than normally attained in any step of the typical use or disposal cycle. For example, U.S. Pat. No. 6,049,918 (the "'918 patent" or "'918 system") relates to a plug sealing the bottom drain or siphon of the toilet bowl. Next, the toilet is flushed and the water level is allowed to rise to a level higher than normally achieved during normal operation of the toilet, but not so great as to overflow the rim of the bowl. Any number of well-known cleaning agents can be added to the water thus contained and allowed to soften and remove stains and deposits from the surface of the toilet bowl and to disinfect the surfaces of the bowl. At the end of a desired soaking period, the surfaces of the bowl may be scrubbed by an individual with a commercially available brush or similar item to remove any lingering deposits.

The '918 system, however, suffers from the shortcomings that there still remains a need to physically scour the toilet bowl surfaces in order to ensure a thorough cleaning and it remains unclear whether the bowl was effectively sanitized. The '918 system still requires human effort to come in close contact with toilet water which now contains potentially harmful cleaning chemicals. A significant and desirable improvement would be to eliminate the need for manual scrubbing of the toilet bowl surfaces while still ensuring the cleanliness of the toilet bowl surfaces.

The present invention addresses the shortcomings of the prior art by providing a hands-free cleaning and disinfecting device that can be automated for sanitizing any enclosure having at least one draining, including but not limited to a toilet bowl, a bidet, a sink, a bathtub, a shower stall, and/or a reservoir.

SUMMARY OF THE INVENTION

It is therefore an object of the present invention to provide a hands-free, automated cleaning and disinfecting device for an enclosure with at least one drainage, including but not limited to a toilet bowl, a bidet, a sink, a bathtub, a shower stall, and/or a reservoir, in which close contact with contaminant is minimized.

It is another object of the present invention to provide a cleaning device having a water level sensing feature in order to prevent water from overflowing during a cleaning cycle.

It is a further object of the present invention to provide a cleaning device having an agitating means capable of cleaning or scrubbing scouring surfaces that may be hard to reach, for example, an interior of a toilet bowl, through agitation of water contained within the toilet bowl.

It is yet another object of the present invention to provide a cleaning device capable of sanitizing any enclosure and/or surface without using harmful chemicals or damaging the environment.

It is still another object of the present invention to provide the cleaning device having at least one water level sensor to prevent the water from exceeding a predetermined level by allowing any additional water to bypass the stopper and exit through a drain.

It is further still an object of the present invention to provide the cleaning device with a water level regulator to regulate the amount of water used to accommodate different sizes and shapes of toilet, bidet, sink, bathtub, shower stall, reservoir and/or any enclosure.

It is yet a further object of the present invention to provide the cleaning device with a removable holder to secure the cleaning device in place during cleaning. The holder may optimally include a rechargeable battery.

These and other objects and advantages will be further explained in the instant invention. In the spirit of explaining the cleaning device in accordance with the present invention the simplest form, application of the cleaning device is exemplified through a toilet bowl. The use of a toilet bowl by no ways limits the application of the cleaning device in accordance with the present invention. The cleaning device is first inserted into a toilet bowl, the water level is raised to the rim of the toilet. The water is agitated through a predetermined frequency which results in a scrubbing action.

An additional feature of the cleaning device in accordance with the instant invention is a resilient stopper whose size is adjustable in order to seal the toilet, create a water-tight seal with a drainage to prevent water from exiting an enclosure during a cleaning cycle. In the case of a toilet bowl, a flush cycle subsequent to sealing the drain would cause the water level in the toilet bowl to rise above the usual level. The stopper therefore may also contain a hollow tube in the center. The hollow tube may extend upward and be used to push excess water through the drain to prevent water from overflowing.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE PREFERRED EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combination, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations come within the scope of the appended claims and their equivalents.

The instant invention is directed to a hands-free cleaning device for cleaning an inside surface of any enclosure having at least one drainage. For example, the cleaning device in accordance with the present invention can be used to clean the inside surface of a toilet bowl, a bidet, a sink, a bathtub, a shower stall, a reservoir, a tank or any enclosure having at least one drain and optimally with water supply. The present invention remedies the short-comings of the conventional cleaning method. Specifically, the use of cleaning agents and sanitizers are well known in the art. Although many cleaning agents have pleasing fragrances intended to mask their natural chemical smell, lessening the user's concern, they are still, nonetheless, harmful to humans, animals and the environment. These cleaning agents are intended for use on an idle toilet with the default water level present in the toilet bowl. Typically, the chemical is placed in the toilet bowl either on the water or internal surface and is allowed to remain in contact with the bowl for a desired amount of time period.

Then the toilet bowl surfaces are scrubbed with a brush or similar item adapted for that purpose. The relatively short handle of the brush or similar item subjects a user to come into close contact with the toilet water and the cleaning agent. In addition, a user has the potential of being splashed with the chemical, bacteria-containing soiled water.

Figure 1:
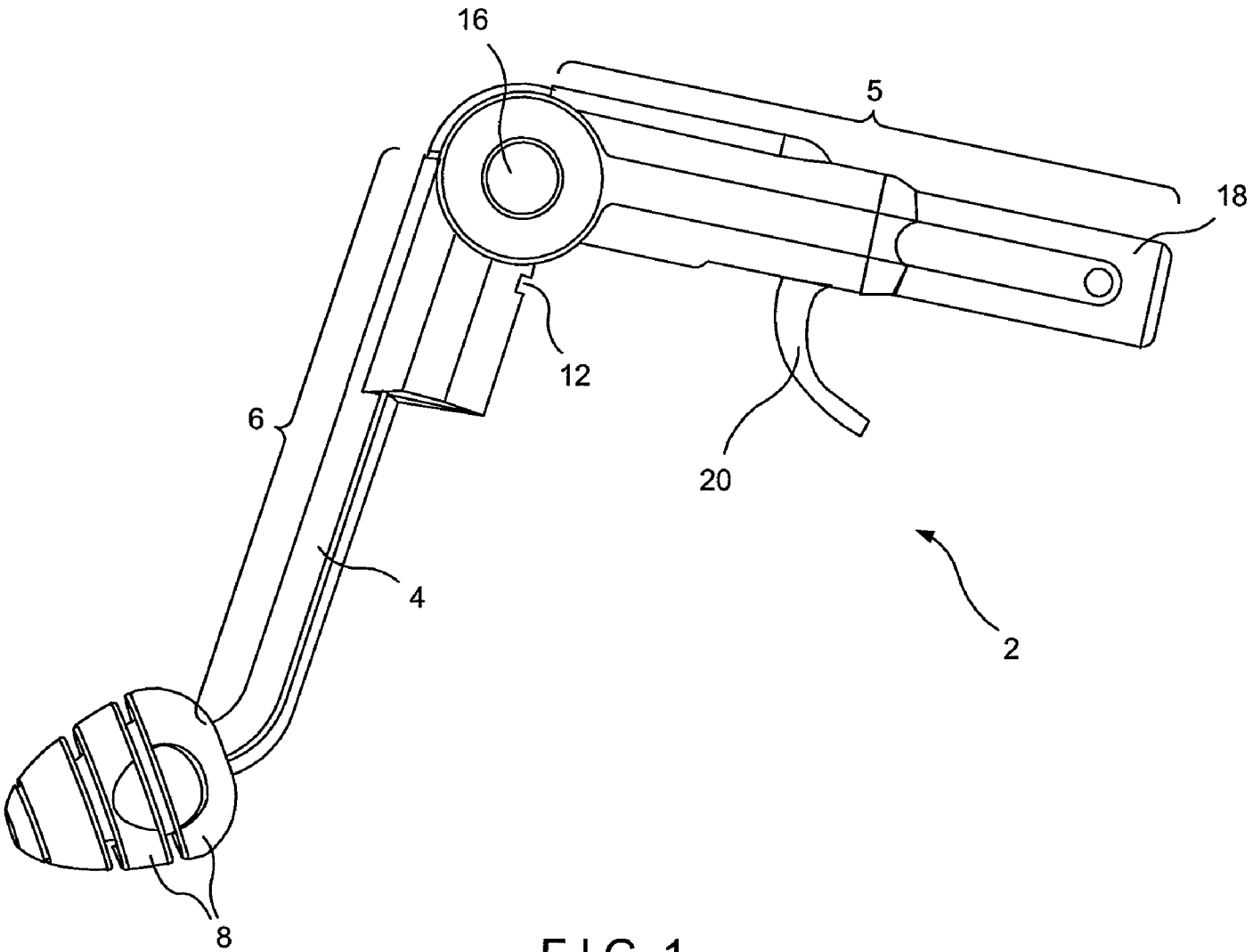
FIG. 1 is a perspective view of the cleaning device, according to one embodiment of the present invention.

As depicted in FIG. 1, one embodiment of the instant cleaning device 2 comprises an elongated member 4 of any suitable length. The elongated member 4 has a first end 6, a second end 5, an inner surface, an outer surface and a substantially hollow interior. Disposed on the first end 6 of the device 2 is an adjustable stopper 8 adapted to form an airtight seal with a drain or siphon. Preferably, the stopper 8 is made from any non-reactive, inert, nonconductive, pliant material, such as, but not limited to, vulcanized rubber or one of the polychloroprene-based synthetic rubbers (for example, neoprene), which can easily conform to the shape and size of any drain or siphon, thereby forming a water-tight seal.

The stopper 8 may be configured as a bellows or other shape that is capable of deforming both the vertical and the horizontal directions with the application of a compressive force exerted along and/or perpendicular to the elongated member 4. As such the stopper may be composed any type of stretchable, deformable material that can form a water-tight seal in any drain when compressed. In one embodiment, the stopper may be inflatable and can be filled with air and/or other appropriate substance. In yet another embodiment, the stopper may be composed of material with shape memory that deforms upon compression, but returns to a regular shape once it is removed from the drain.

By way of example, in a toilet bowl when the stopper is deformed, the volume defined by the inside surface of the stopper 8 is reduced and any fluids (liquids and/or gasses) contained within the stopper 8 will become pressurized. Thus, the cleaning device 2 fitted with a deformable stopper 8 can be appropriately placed over a clogged toilet bowl drain to provide a seal with the inner surface of the toilet bowl, trapping any fluids present between the blockage and the stopper 8. A downward force applied to the cleaning device 2 along the elongated member 4 would cause the stopper 8 to become reduced in volume, pressurizing the contained fluids to dislodge to blockage, similar to a conventional plunger.

In order for the stopper 8 to assume an optimum angular relationship with the opening of a drain while allowing the elongated member 4 to maintain a substantially vertical orientation, the first end 6 and second end 5 of the elongated member 4 are connected by a connector, for example, a gimbal assembly or any connecting means that provide a swivel movement. When properly placed in the opening of a drain, stopper 8 forms a water-tight seal with the enclosure bowl that prevents water contained within from passing through to opening of a drain.

The cleaning device can optimally have a removable clip that secures the cleaning device to an enclosure to be cleaned. This helps steady and keep the device properly oriented.

Thus, in the case of a toilet, if the toilet flush cycle were to be initiated with the cleaning device 2 properly in place in the waste drain opening, the water introduced into the toilet bowl would be prevented from discharging and the water level in the toilet bowl would rise above the default water level. The water level may be permitted to rise to a level just below the rim of the toilet bowl to substantially cover the entire interior toilet bowl surface, including the area just below the toilet bowl rim.

As shown in FIG. 1, a gripping member 18 is removably disposed at a second end 5 of the cleaning device 2. The gripping member 18 is sized and shaped for comfortable gripping by a user. In one embodiment, the gripping member 18 is generally cylindrical in shape with a longitudinal axis that is substantially aligned with the longitudinal axis of the cleaning device's elongated member 4. Another exemplary embodiment of a gripping member 18, it could be generally cylindrical in shape with a longitudinal axis that is substantially perpendicular to that the longitudinal axis of the elongated member 4. Additional exemplary gripping members can comprise sensory stimulating elements such as sound or light emitters for entertainment purposes, or decorative elements, such as a snow globe or a stylized head, to increase aesthetic appeal, to fit with the chosen décor of the room, or for pure whimsy. As will be readily apparent to those skilled in the art, the gripping member 18 could have any shape or geometry that allows a user to grasp the instant device for insertion in and removal from a toilet bowl. The gripping member may be an extension of the elongated member 4 or removably connected to or fastened to the rest of the cleaning device 2 by a connecting means.

The elongated member 4 is adjustable. A user may desire the length to be suitable to appropriately locate the gripping end 18 an appropriate distance from the stopper 8 of the cleaning device 2 for a user's safety, leverage, easy handling, and to accommodate the size of the enclosure to be cleaned.

The elongated member 4 and the gripper end may be connected to a connecting means, such as a gimbal assembly. The connecting means 16 allows the device to bend in order to aid use and positioning in an enclosure. Any bendable or rotary type means may be used as a connecting means. Furthermore, the cleaning device 2 may include a clip 20. Clip 20 provides support such that the cleaning device 2 may be securely placed within the enclosure to be cleaned. The clip in one embodiment may, for example, be attached to the toilet lip of the toilet bowl to provide support for the cleaning device. The gripping end 18 can be removably attached to the elongated member 4 or as part of the elongated member 4, thus when the clip 20 is in position, gripping end 18 can be removed in the case of a toilet bowl so the toilet cover can cover the toilet bowl in order to create an enclosed cleaning environment for the cleaning device. In other embodiments, the clip may be used to hang up the device when it is not in use.

The elongated member 4 may be shaped like any elongated structure. The shape and size of the elongated member 4 can be scaled and adapted to accommodate the shape and size of an enclosure to be cleaned, and it can also be constructed to increase aesthetic appeal, to maintain the décor of the room or for pure whimsy. In one embodiment, the elongated member 4 is made from any rigid, lightweight, durable, inert and non-conductive material such as, for example, polypropylene or polyvinyl chloride (PVC) or any suitable material.

As can also be seen in FIG. 1, the cleaning device 2, may further comprise a water level regulator (not shown). In one embodiment, the water level regulator 12 is connected to the substantially hollow cavity of the elongated member 4. The water level regulator 12 can be used to regulate water level in any enclosure to be cleaned and to prevent water level from surpassing a certain height level by directing excess water to be flushed through a drain. It should be noted that in certain embodiments the hollow cavity in the elongated member 4 extends through the stopper 8 at the first end 6 of the device. When the cleaning device 2 is installed, in the case of a toilet bowl and the bowl is flushed, the water level in the bowl rises until it reaches the level of the water level regulator 12 disposed in the side wall of the elongated member 4, although the water level regulator can be placed at any part of the cleaning device 2 in order to perform optimally. At this point, the rising water may flow through the water level regulator 12 and into the elongated member's hollow cavity. In some preferred embodiments, the overflow water will be regulated by the water level regulator 12 and the water will drain down through the elongated member 4 and the stopper 8 into the drain opening through one or more valves disposed within the stopper 8. Therefore, the water level regulator 12 prevents the water level in any enclosure to rise a predetermined optimal height. In a preferred embodiment, the water level regulator 12 is positioned below the level of the edge of an enclosure, and in the case of a toilet, will be immediately below the rim of the toilet bowl. In order to avoid overflow of water the water level regulator 12 may be adjustable. The water level regulator 12 has an adjustable opening in the side wall of the elongated member 4 and it may contain a sliding member disposed on the exterior of the elongated member 4. By way of example, in order to adjust the water level in, for example, a toilet bowl for a specific toilet bowl configuration, a user slides the sliding member up or down to either cover up or reveal more of the opening of water level regulator 12. For example, to raise the cleaning water level in a toilet bowl, a user slides the sliding member up towards the connecting means 16 of the cleaning device 2, thereby covering up more of the opening of the water level regulator 12. If a user wants to lower the cleaning water level in the toilet bowl, the user simply slides the sliding member down towards the stopper 8 of the cleaning device 2, thereby exposing a bigger opening of the water level regulator 12. Accordingly, the cleaning water level in the toilet bowl will rise to the level associated with the top end of the sliding member so the rising water will flow through the opening of water level regulator 12 and into the elongated member 4's hollow cavity where it will be drained down through the elongated member 4, and optionally through the stopper 8 into the toilet drain.

In order to clean the toilet bowl, the cleaning device 2 further comprises one or more agitation means. Agitation of the water contained in the toilet bowl produces a scouring or cleaning action on the surfaces of the toilet bowl. Such agitation means can be accomplished either through a control circuit and/or human input and through any number of generation means, including but limited to pumps, compressors, aerators, wave generators or oscillators.

In another embodiment, the agitation means would be capable of producing high frequency oscillations between 8 kHz and about 300 kHz, preferably between 10 kHz and 100 kHz and more preferably between 12 kHz and 80 kHz, and most preferably between 15 kHz and 70 kHz. These frequency ranges are akin to that used in ultrasonic jewelry cleaners. For example, Branson Ultrasonics Corporation offers Model B200 Ultrasonic Cleaner, operating at 40 kHz, for removing dirt, oils, and dust from jewelry and optical lenses. A similar ultrasonic means, such as an ultrasonic transducer may be incorporated on the cleaning device. In one embodiment there may be one or more user controls connected to circuitry that controls the operation of the agitating means. When activated, the ultrasonic means can be used to generate ultrasonic waves in the water disposed within any enclosure to be cleaned.

Additional examples of agitation means including, but are not limited to: means capable of producing low frequency oscillations, as in hydro massage units, water jets, and air bubbling devices.

In another exemplary embodiment, the cleaning device may include components that regulate a cleaning cycle. For example, a safety circuit such as an orientation sensor may be integrated in the cleaning device for determining the tilt to cleaning device. For the device to work properly and without unwanted effects, including water splashage, the cleaning device 2 must be situated at a certain tilt and in some embodiments preferably does not protrude from the rim and/or edge of the enclosure to be cleaned so the enclosure, and in the example of a toilet bowl, the toilet lid can cover the toilet bowl during a cleaning cycle. An orientation sensor can also be used as a safety feature to deactivate the cleaning device if the cleaning device did not have the optimal tilt. Thus, in the event if the cleaning device is not properly situated, the orientation sensor will interface with control circuitry to stop the cleaning device from entering into a cleaning mode. In a different embodiment, a water level regular system can have the same function as the orientation sensor. In such an embodiment, a sensor could be placed on the outside of the cleaning device for determining how high the water is with respect to the cleaning device. The sensor will convey the information to the control circuit 42 which reads signals from the one or more sensors and provides instructions through electrical signals to the agitations means of the device. If the water level is not within a certain height range, the device will again be prevented from going into one or more cleaning modes. Among other things, the water level sensor would prevent operation of the cleaning device that is not inserted in water. A problem that could otherwise occur is if the cleaning device is not placed in the water and the agitating means is activated, the agitating means can be damaged.

In yet another embodiment of the present invention, sanitization of an enclosure can be accomplished by exposure to ultraviolet (UV) light from a source on the cleaning device producing UV light of wavelength ranges of about 360 to about 410 nm. An additional discussion of sanitization by using UV light can be found in U.S. application Ser. No. 11/635,104, filed Dec. 12, 2007. A UV light means 46 may be provided on the elongated member 4 at an optimal height for irradiating surfaces of any enclosures to be cleaned with sufficient near UV radiation to sanitize the exposed surfaces. The UV radiation may originate from a single fixed source, a moving or rotating source, or a plurality of UV sources arranged on the elongated member 4. The cleaning device 2 may also be sanitized by the UV light means 36 following use. In a different embodiment, the cleaning device 2 may be controlled by at least one control which may affect its positioning, magnitude of light source, and other related characteristics. There may optionally be a timer means coupled with the ultraviolet source such that one or more pre-programmed UV sanitation cycles may occur.

Figure 1A:
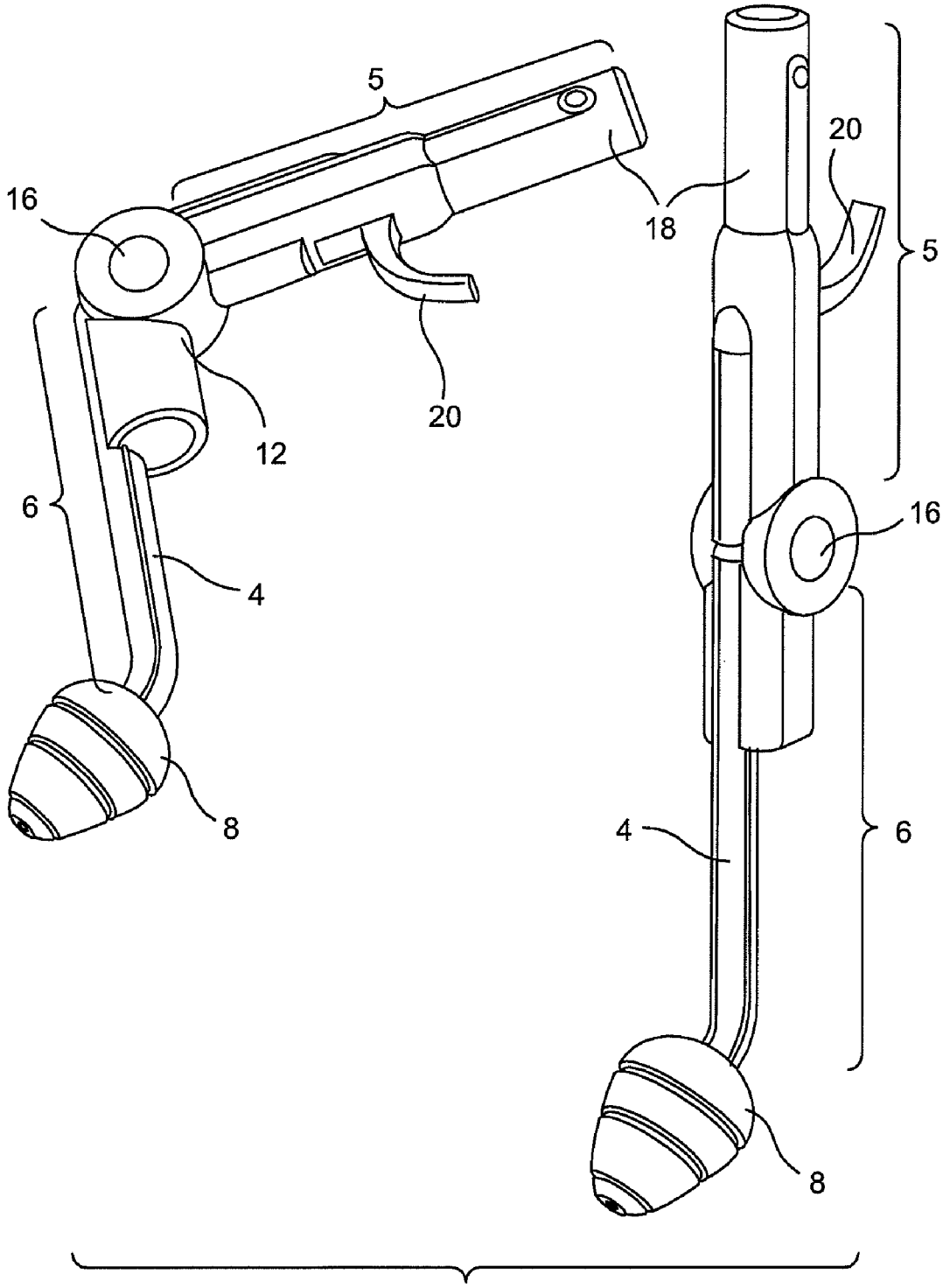
FIG. 1A is a photograph of the cleaning device, according to one embodiment of the present invention.
Figure 1B:
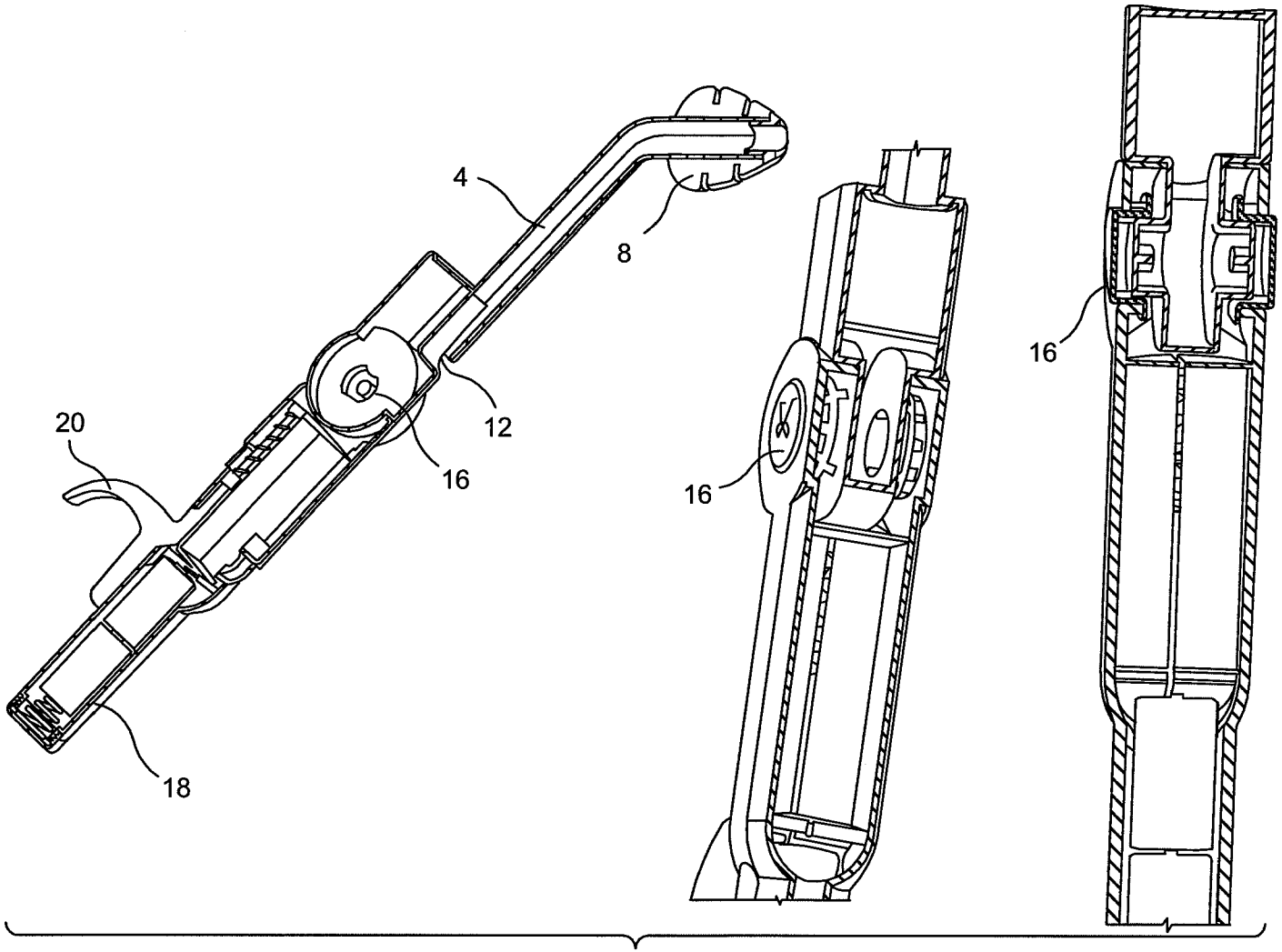
FIG. 1B is a photograph of an exploratory view of a the second end of the cleaning device, according to one embodiment of the present invention.
Figure 1C:
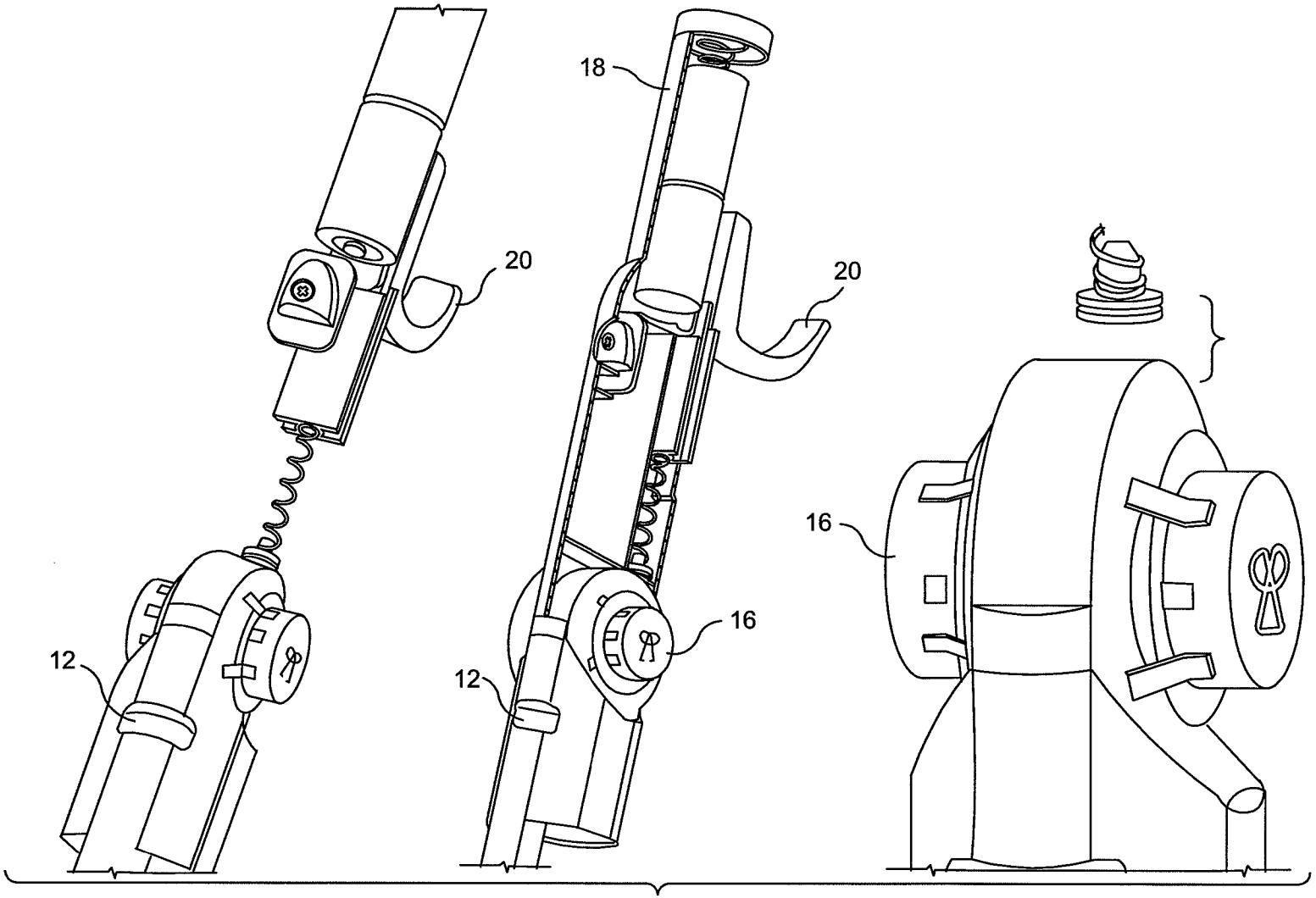
FIG. 1C is photograph depicting a cross section of the cleaning device, according to one embodiment of the present invention.

FIGS. 1A, 1B and 1C depict a prototype of the cleaning device according to one embodiment of the present invention.

Figure 2:
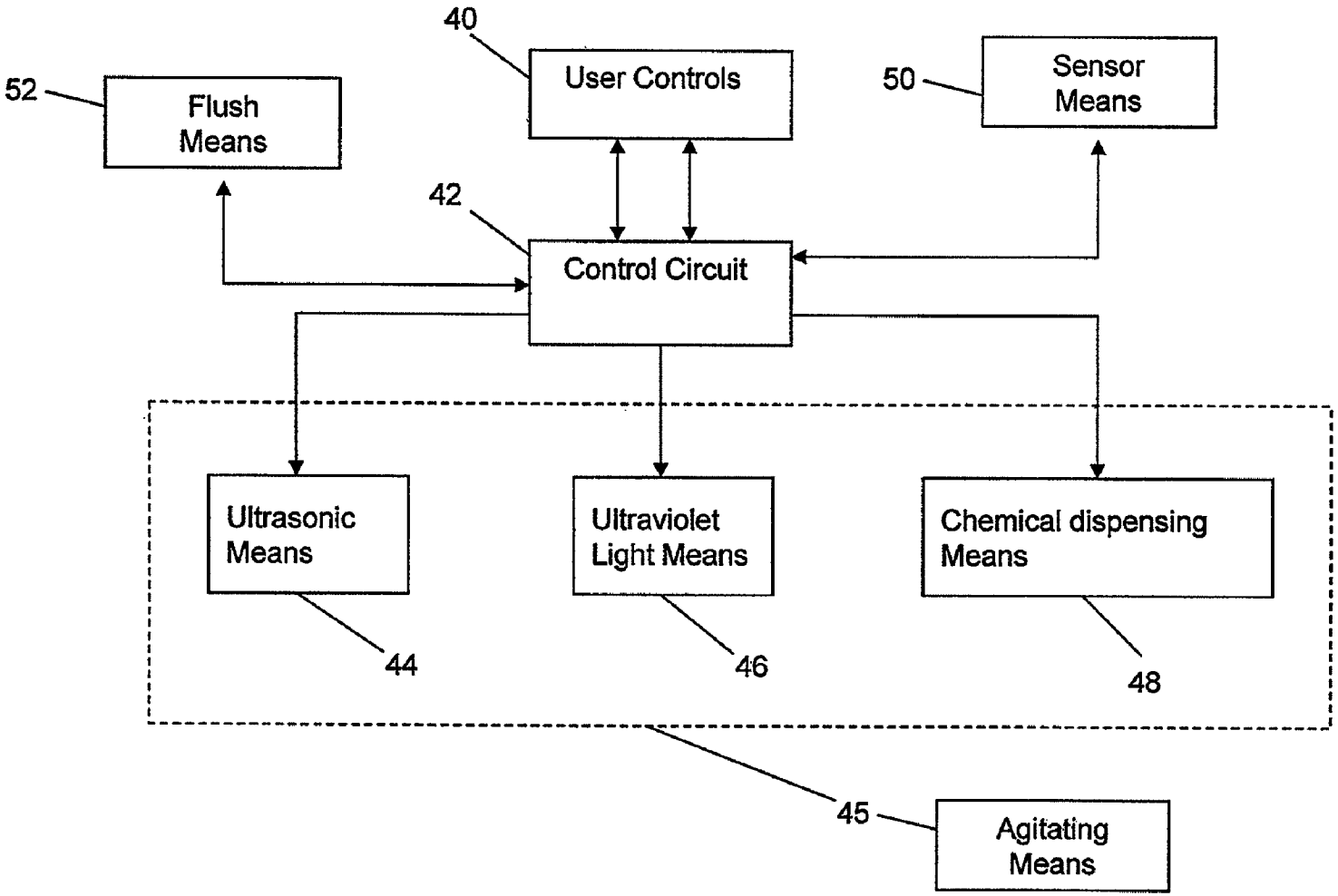
FIG. 2 is a block diagram of the electronic components integrated within the cleaning device in accordance with the present invention.

FIG. 2 is block diagram of a preferred embodiment of the electrical components that in whole or in part may be included in the cleaning device. For example, one embodiment as shown in FIG. 2 has a control circuit 42 connected to multiple agitation means such as an ultrasonic means 44, ultraviolet light means 46, and/or a chemical dispensing means 48. Also connected to the control circuit is a flush means 52 and sensor means 50 which contains at least one sensor to provide feedback to both the user and control circuit.

Examples of the ultraviolet light means and ultrasonic means were mentioned previously. One skilled in the art would recognize the vast possible variations of means of the same kind that could be incorporated in the cleaning device according to the present invention without departing from the scope of the invention.

The flush means 52 may be a solenoid means connected to at least one drainage valve within the stopper. The control circuit 42 may, upon user command, or in sequence of a program, interact with the flush means to induce a flushing.

This may occur at the end of a cleaning cycle, for example, after the surfaces of an enclosure have been cleaned.

The cleaning device may optionally have a chemical dispenser that releases certain chemicals upon command into the enclosure to be cleaned. The chemicals may be advantageously disposed into an enclosure to be cleaned to further sanitize the enclosure. The cleaning dispensing means may have electronic means that regulates the release of chemicals. In other preferred embodiments, the chemical dispensing means, as seen in FIG. 2, will release chemical upon command from the control circuit 42. The chemical dispensing means may contain at least one compartment to store at least one chemical. Based on the commands, the chemical dispensing means will release carefully controlled quantities of one or more of the chemicals. In further embodiments, the chemical dispensing means may have a sensor to indicate to the control circuit and ultimately the user that it is running low on certain chemicals. The chemicals may include but are not limited to any chemicals that aid in the cleaning and sanitization of any surfaces.

The control circuit in one embodiment may be a processor, a memory means, a display means, and/or an interface. The interface is connected to an agitation means 45.

Connected to the control circuit 42, is a user control 40 for controlling the operation of the agitation means 45. In one embodiment, the user control 40 may comprise switches or controls that directly affect the operation of ultrasonic means 44 in order to change the frequency it produces.

Alternatively, a user, via the user control 40 may indicate having at least one cleaning program that is built-in the control circuit 42 of the cleaning device 2. In such an embodiment the control circuit will control the agitation means 45 according to a cleaning cycle pre-programmed and stored in the memory means. The control circuit will use the program in certain embodiments to automatically control the agitating means. The agitating means may have a frequency sensor as part of the user control 40 which is connected to the control circuit 42. Based on the feedback from the sensor, the control circuit 42 may automatically alter the operation of the ultrasonic means 44 such that the ultrasonic means' operation frequency is adjusted to operate at the optimal frequency, such as resonant frequency. Alternatively, the control circuit 42 may indicate the information provided by one or more sensors to the user via a display connected to the control circuit. The user may either directly control the agitating means or allow the control circuit to control the agitation means.

For example, a resonant frequency may provide better cleaning results in removing residue from a toilet surface. In addition the control circuitry 42 may include timer functionality. It may be advantageous to cyclically turn the ultrasonic means on and off, in addition to varying its operation frequency. In order to activate the agitating means 45, an actuator or a switch is included in the user controls 40. Such an activation means include but are not limited to an on-off switch, a timer, a timer with an audible or visual alarm, a float switch, or any other activation means known in the art.

Power for such means can be provided by voltaic cells or batteries, such as disposable batteries, or, preferably, rechargeable batteries or rechargeable battery packs. Multiple batteries may be used to provide desirable features having long life and high energy. The batteries or battery packs may be disposed within the cleaning device 2 to keep them separated from the wet environment in which the cleaning device is typically used and to provide ready access for replacement as necessary. Appropriate electrical leads may connect the battery pack with the agitating means 45.

In order to increase the effectiveness of the instant cleaning device, commercially available cleaning agents may be used in conjunction with the agitating means for enhanced cleaning results. A brush or other similar means may be included on the cleaning device 2 along with a receptacle for the brush or similar item. The receptacle could be any appropriate shape with an opening at one end to receive the wetted end of the brush or cleaning device 2 following use, and an essentially closed end. Drainage holes may be provided to allow any remaining liquid on the brush to drain following use. In one embodiment of the instant invention, a receptacle may be disposed on the elongated member 4 such that the receptacle and the brush are subject to irradiation from the UV light means 46 at sufficient levels to sanitize the brush and receptacle. In another embodiment of the instant invention, the receptacle (not shown) comprises a UV light means on the inside of the receptacle for irradiating the wetted end of the brush means to sanitize the brush. A power source integral to or separate from the agitation means may be provided for the UV light means.

A power source for the agitating means 45, a flush means, and a sensor system can be secured at a suitable location, for example along the inside surface of the substantially hollow elongated member 4 by a battery securing means.

When not in use, the cleaning device 2 may be secured in a suitably shaped holder. The holder may be of any shape to accommodate and hold the cleaning device 2 in a desired position, for example, in a generally upright position. Provided on the interior of the holder may be a UV light source or sources to irradiate the wetted lower surfaces of the cleaning device 2 with sufficient near UV radiation to sanitize the cleaning device 2.

In another embodiment, one or more sections of the cleaning device may be coated to protect the device and keep the device clean and bacteria free. For example, the cleaning device 2 may be coated in part with an anti-microbial resistant layer in order to keep the device sanitized. In other embodiments, a hydrophobic coating may be used such as to prevent water from waking or entering the inner layers of the device. One skilled in the art would recognize that there may be a wide range of similar type coatings to protect the device from wear and tear and contamination and keep the device substantially germ-free or germ-resistant.

Figure 3:
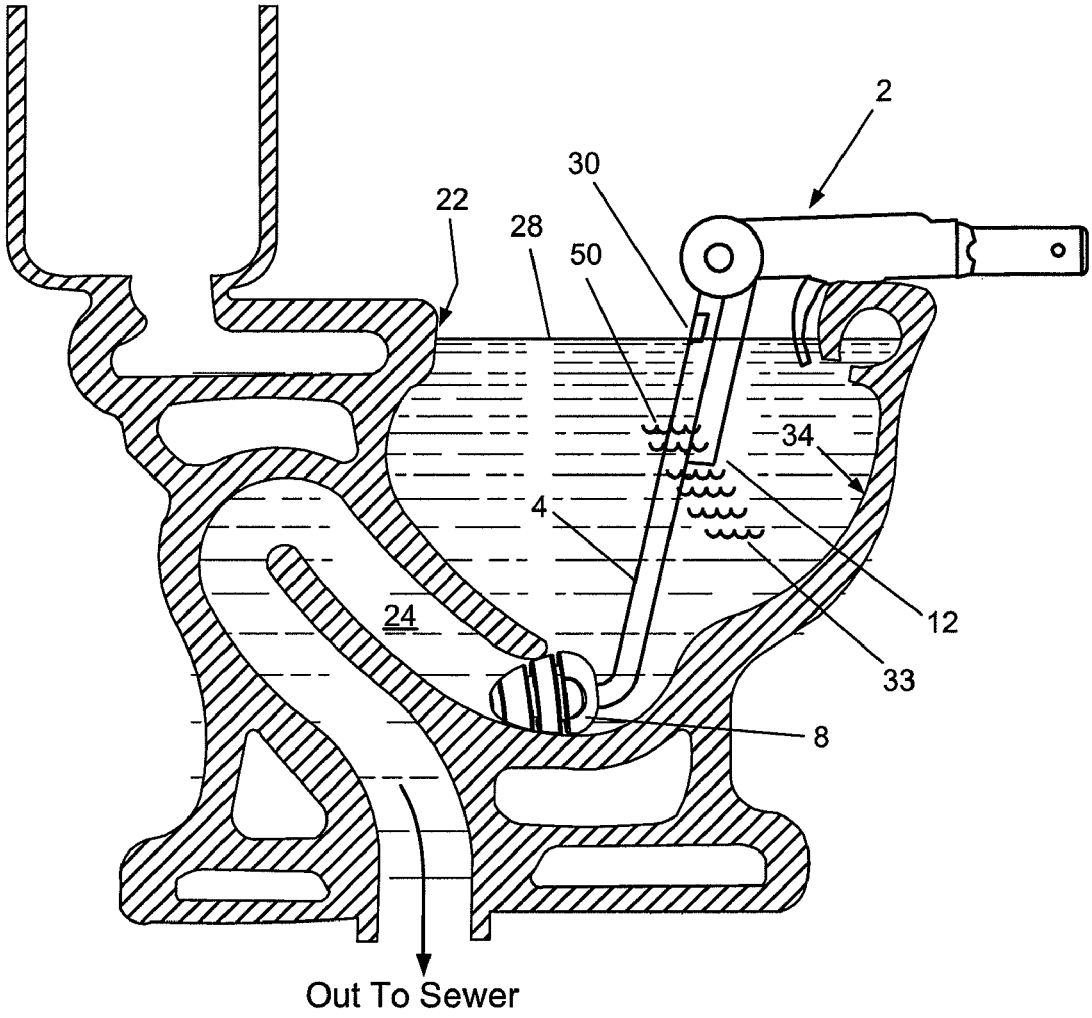
FIG. 3 is a cross-sectional view of a toilet bowl having the cleaning device of the present invention inserted therein.

Operation of the instant cleaning device will be further described below. As depicted in FIG. 3, by way of example, illustrating a toilet bowl whereby the cleaning process begins with a user placing the instant cleaning device 2 into a toilet bowl 22 such that the stopper 8 forms a water-tight seal with the drain or siphon 24. After the cleaning device 2 is in place, a user flushes the toilet 22 causing the cleaning water level in the bowl 26 to rise as a result of the sealed toilet drain 24. The cleaning water level 28 will continue to rise until it reaches the level of the water level regulator 12. At this level, the rising water will flow through the water level regulator and into the elongated member's hollow cavity where it will be drained through the elongated member 4, through the stopper 8 and into the toilet drain 24. After the toilet bowl stops filling and the cleaning water level 28 is reached, the user activates the water agitating means 45 (not shown) in order to agitate water 33. As a result, the agitated water cleans and scrubs the interior surface 34 of the toilet bowl 22. The water agitating means 45 can run for a preset time, for example, with the use of a timer, or the agitating means 45 may be manually turned on an off by user by way of a switch located on the cleaning device 2. Additionally, the agitation means 45 can run for a predetermined cycle of, for example, with varying intensity or duration with the use of a suitable timer to produce the desired cleaning result.

To enhance the effectiveness of the instant cleaning device's ability to clean any enclosure having at least one drain, any commercially available cleaning fluids may be optionally sued in conjunction. After the agitating means 45 has run for a desired period of time, a user removes the cleaning device 2 from the toilet bowl 22, as shown in FIG. 3, thereby unplugging the toilet drain 24. After the cleaning device 2 is removed, a user may flush the toilet to drain the excess liquid from the toilet.

Upon completion of using the cleaning device, the cleaning device 2 can be placed a holder for storage. Upon sensing the presence of the cleaning device 2, the control circuit 42, based on feedback from the sensor means 50, may trigger a UV light source from ultraviolet light means 46 to initiate a sanitization cycle of near UV irradiation to the cleaning device 2. In one embodiment, the sanitizing cycle is initiated by the presence of the cleaning device 2 in the holder and terminated by a timing means or the removal of the cleaning device.

Figure 4:
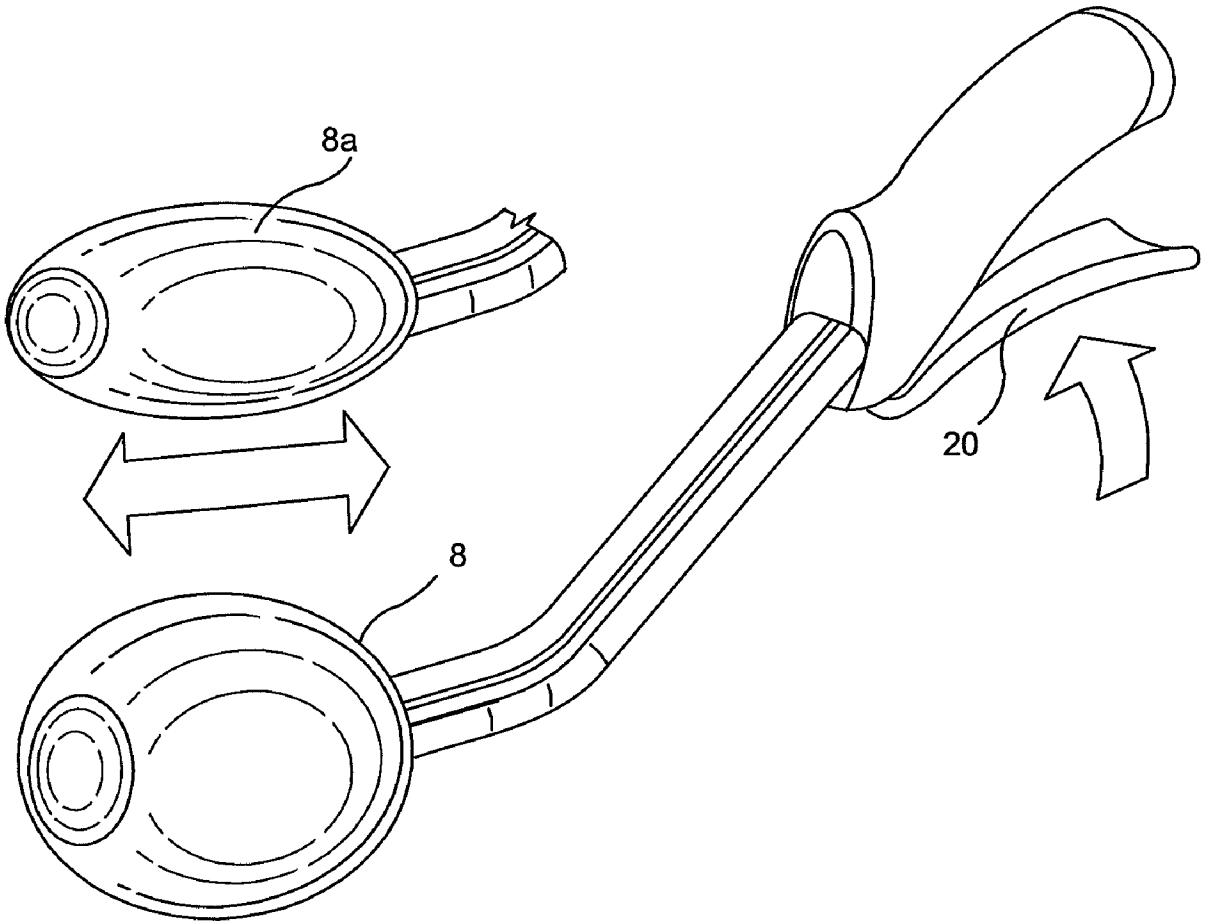
FIG. 4 is a plain view of the cleaning device, according to one embodiment of the present invention.

FIG. 4 depicts yet another embodiment of the present invention whereby the size of stopper 8 is adjustable in order to create a water-tight seal with a drain of any size, shape and dimension.

Although a preferred embodiment of the present invention and modifications thereof have been described in detail herein, it is to be understood that this invention is not limited to the precise embodiments, modifications and applications described herein and that other modifications, variations and applications may be employed by one skilled in the art without departing from the spirit and scope of the present invention as defined by the appended claims.

What is claimed is:

1. A cleaning device operable for cleaning an enclosure that includes (i) an interior surface capable of enclosing a liquid, and (ii) a drain, the cleaning device comprising:

an elongated member having a sidewall, an outer surface, an inner surface, a first end, a second end, and a substantially hollow cavity;

a stopper disposed on said first end;

a liquid level regulator configured such that when said stopper is positioned in the drain of the enclosure, the liquid level regulator is operable to prevent liquid enclosed by the interior surface of the enclosure from overflowing the enclosure;

a cleaning means configured such that when said stopper is positioned in the drain of the enclosure, the cleaning means is operable to cause cleaning of the interior surface of the enclosure; and control means configured to interface with the cleaning means.

2. The cleaning device as claimed in claim 1, wherein the first end and the second end of the elongated member can be connected by a connector.

3. The cleaning device as claimed in claim 1, wherein said stopper contains at least one drain valve allowing fluids to pass into a drainage.

4. The cleaning device as claimed in claim 1, wherein the device includes a flushing means.

5. The cleaning device as claimed in claim 4, wherein said flushing means includes at least one solenoid valve integrated in the cleaning device to induce flushing through the cleaning device.

6. The cleaning device as claimed in claim 1, wherein said elongated member can optionally have a handle that is either integral or removably attached.

7. The cleaning device as claimed in claim 1, wherein said cleaning means is an agitating means comprises at least one or more means selected from a pump, a compressor, an aerator, a wave generator, a light source, and an oscillator.

8. The cleaning device as claimed in claim 1, wherein said stopper is constructed from an inert, non-conductive, pliant material capable of expanding or contracting to form a water-tight seal.

9. The cleaning device as claimed in claim 8, wherein said inert, non-conductive, pliant material is selected from the group consisting of a vulcanized rubber and a polychloroprene-based synthetic rubber.

10. The cleaning device as claimed in claim 1, wherein said elongated member is constructed from a rigid, lightweight, durable, inert and non-conductive material.

11. The cleaning device as claimed in claim 10, wherein said rigid, lightweight, durable, inert and non-conductive material is selected from the group consisting of polypropylene and polyvinyl chloride.

12. A cleaning device comprising:

an elongated member having a sidewall, an outer surface, an inner surface, a first end, a second end, and a substantially hollow cavity;

a stopper disposed on said first end;

a control means;

a water level regulator comprising a device for guiding water into an elongated opening of said elongated member, and a sliding member for adjusting said elongated opening in order to control water level; and a cleaning means.

13. A cleaning device comprising:

an elongated member having a sidewall, an outer surface, an inner surface, a first end, a second end, and a substantially hollow cavity;

a stopper disposed on said first end;

a control means;

a water level regulator configured such that when said water level regulator is activated, excess fluid is pulled through an overflow valve and into the hollow cavity of said elongated member; and a cleaning means.

14. A cleaning device comprising:

an elongated member having a sidewall, an outer surface, an inner surface, a first end, a second end, and a substantially hollow cavity;

a stopper disposed on said first end having at least one one way valve;

at least one sensor means disposed on said elongated member;

a water level regulator means disposed on said elongated member;

at least one agitating means; and a control means for interfacing with at least one of the sensor means, water regulator means, and an agitating means.

15. The cleaning device as claimed in claim 14 has at least one safety circuit capable of monitoring the cleaning device positioned at an optimal angle and/or detecting the amount of liquid in an enclosure having at least one drain.

16. The cleaning device as claimed in claim 14, wherein said device is triggered into one or more cleaning cycle modes depending on feedback from one or more sensors connected to the control means.

17. The cleaning device as claimed in claim 14 wherein said at least one agitating means is an ultrasonic transducer that produces oscillations at a frequency between about 8 kHz and about 300 kHz.

18. The cleaning device as claimed in claim 14 wherein said at least one agitating means is an ultrasonic transducer that produces oscillations at a frequency between about 10 kHz and about 100 kHz.

19. The cleaning device as claimed in claim 14 wherein said at least one agitating means is an ultrasonic transducer that produces oscillations at a frequency between about 12 kHz and about 80 kHz.

20. The cleaning device as claimed in claim 14 wherein said at least one agitating means is an ultrasonic transducer that produces oscillations at a frequency between about 15 kHz and about 70 kHz.

21. The cleaning device as claimed in claim 14 wherein said at least one agitating means is an ultrasonic transducer that produces oscillations at a frequency at about 15 kHz when operated.

* * * * *